US011685134B2

(12) United States Patent
Haigis et al.

(10) Patent No.: US 11,685,134 B2
(45) Date of Patent: Jun. 27, 2023

(54) METHOD OF CUTTING OFF LABELS

(71) Applicant: Bizerba SE & Co. KG, Balingen (DE)

(72) Inventors: Joerg Haigis, Balingen (DE); Moritz Dehner, Hechingen-Stetten (DE); Pascal Eppler, Albstadt-Laufen (DE); Alexander Hirsch, Stuttgart (DE); Peter Will, Balingen (DE)

(73) Assignee: Bizerba SE & Co. KG, Balingen (DE)

( * ) Notice: Subject to any disclaimer, the term of this patent is extended or adjusted under 35 U.S.C. 154(b) by 0 days.

(21) Appl. No.: 17/370,708

(22) Filed: Jul. 8, 2021

(65) Prior Publication Data

US 2022/0009190 A1 Jan. 13, 2022

(30) Foreign Application Priority Data

Jul. 10, 2020 (EP) ..... 20185206

(51) Int. Cl.

*B31D 1/02* (2006.01)
*B26D 1/10* (2006.01)
*B26D 5/02* (2006.01)

(52) U.S. Cl.

CPC ..... *B31D 1/026* (2013.01); *B26D 1/105* (2013.01); *B26D 5/02* (2013.01); *B31D 1/027* (2013.01); *B26D 2210/11* (2013.01)

(58) Field of Classification Search

CPC . B26D 1/04; B26D 1/18; B26D 1/185; B26D 1/14; B26D 7/2635; Y10T 83/8821;
(Continued)

(56) References Cited

U.S. PATENT DOCUMENTS 4,440,055 A * 4/1984 Gelfand ..... B26D 7/2614 83/564
4,535,664 A 8/1985 Raymond
(Continued)

FOREIGN PATENT DOCUMENTS

DE 199 58 274 A1 6/2001
EP 1 356 947 A1 10/2003
(Continued)

OTHER PUBLICATIONS

European Search Report dated Nov. 30, 2020 of corresponding European Patent Application No. 20185212.6 (three pages).
(Continued)

*Primary Examiner* — Jennifer S Matthews
(74) *Attorney, Agent, or Firm* — Kilpatrick Townsend & Stockton LLP

(57) ABSTRACT

Disclosed is a method of cutting off self-adhesive linerless endless tape labels, using a cutter of a label printer, wherein the cutter comprises a transport roller, which is rotatable about an axis of rotation, and a blade unit that is linearly travelable in parallel with the axis of rotation of the transport roller and that has a cutting blade directed in the direction toward the transport roller, where tape labels pass between the transport roller and the blade unit, and are transported further step-wise in a motorized manner, by one label, and, between two consecutive further transport steps, the blade unit is linearly traveled in a motorized manner between a start position and a target position in order to cut off a label, such that the label is completely cut off and is held at the transport roller by the blade unit in the target position of the blade unit.

11 Claims, 11 Drawing Sheets

Figure 1:
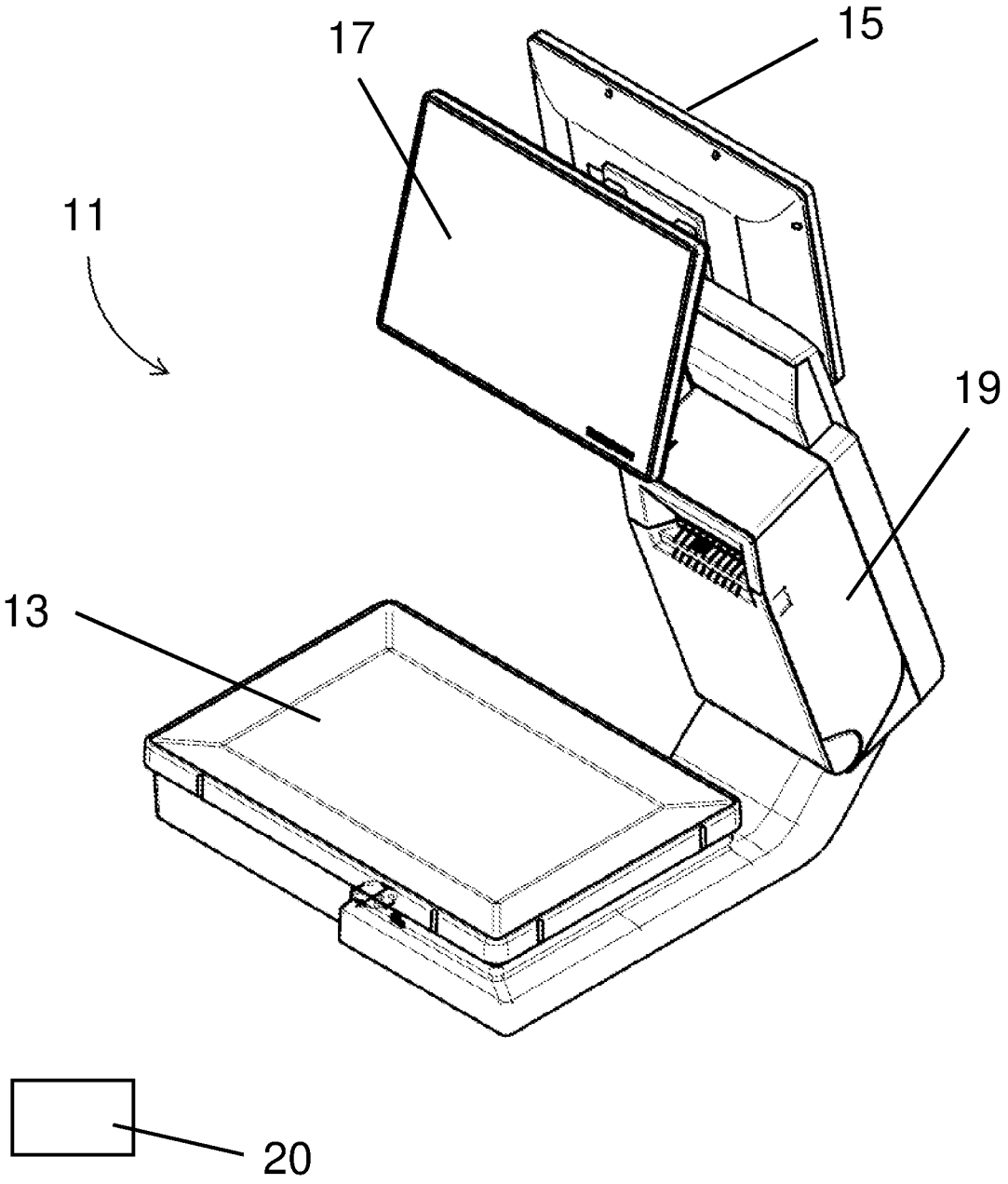

(58) Field of Classification Search
CPC .. Y10T 83/8822; Y10T 83/7507; B31D 1/026
See application file for complete search history.

(56) References Cited

U.S. PATENT DOCUMENTS

| | | | | | |
|---|---|---|---|---|---|
| 4,979,838 | A * | 12/1990 | Yokota | B41J 11/706 | 400/621 |
| 5,442,983 | A * | 8/1995 | D'Angelo | B26D 7/025 | 83/578 |
| 5,611,253 | A * | 3/1997 | Saito | B65H 35/0066 | 83/676 |
| 5,819,618 | A * | 10/1998 | Rodriguez | B26D 1/185 | 83/485 |
| 6,651,537 | B1 * | 11/2003 | Pfeiffer | B65H 35/06 | 83/698.21 |
| 10,265,968 | B2 | 4/2019 | Holike et al. | | |
| 10,494,131 | B2 | 12/2019 | Mistyurik et al. | | |
| 2008/0250909 | A1 * | 10/2008 | Sudmalis | B26D 1/185 | 83/455 |
| 2014/0028752 | A1 | 1/2014 | Kikura et al. | | |
| 2018/0312289 | A1 * | 11/2018 | Gomes Da Costa | B26D 3/085 | |
| 2019/0202654 | A1 | 7/2019 | Dehner et al. | | |
| 2020/0087015 | A1 * | 3/2020 | Stern | B41J 11/703 | |

FOREIGN PATENT DOCUMENTS

| | | | | |
|---|---|---|---|---|
| EP | 1 559 566 | A1 | 8/2005 | |
| EP | 3 505 355 | A1 | 7/2019 | |
| EP | 3 318 412 | B1 | 10/2019 | |
| EP | 3 619 012 | A1 | 3/2020 | |
| GB | 2289430 | A * | 11/1995 | B26D 1/205 |
| WO | 2018/204397 | A1 | 11/2018 | |

OTHER PUBLICATIONS

European Search Report dated Mar. 5, 2021 of corresponding European Patent Application No. 20185206.8 (four pages).

* cited by examiner

METHOD OF CUTTING OFF LABELS

This application claims priority to European Patent Application 20185206.8, filed on Jul. 10, 2020, the disclosure of which is incorporated by reference herein.

The invention relates to a method of cutting off self-adhesive linerless endless tape labels or carrier tape labels using a cutter of a label printer, wherein the cutter comprises a transport roller, which is rotatable about an axis of rotation, and a blade unit that is linearly travelable in parallel with the axis of rotation of the transport roller and that has a cutting blade directed in the direction toward the transport roller, in which the endless tape or carrier tape labels pass between the transport roller and the blade unit, the endless tape or carrier tape labels are transported further step-wise in a motorized manner, in each case by one label, and, in each case between two consecutive further transport steps, the blade unit is linearly traveled in a motorized manner between a start position and a target position in order to cut off a label.

To be able to process linerless endless tape labels coated with an adhesive at one side, which are also called linerless labels, or carrier tape labels in which the labels are attached to a carrier tape, a cutter or a label printer having a cutter, by which the labels are cut off, is required. In the case of a batch production, the labels can be collected in a collection box after the cutting process and can be kept ready for a use. If only individual labels should be printed on demand, a so-called presenter can be connected downstream of the label printer or the cutter, said presenter peeling off the respective cut-off label when it leaves the label printer or the cutter. The next label will in this respect only be printed when the cut-off label is removed by the presenter. Such presenters can be integrated in a label printer from the start or retrofitted as accessories. In both cases, it is an additional and thus costly component.

It is the underlying object of the invention to provide a method of the initially mentioned kind that provides a more cost-effective possibility of individually removing cut-off labels on the use of endless tape or carrier tape labels.

This object is satisfied by a method having the features of claim 1, and in particular in that the blade unit is traveled such that the label is completely cut off and is held at the transport roller by the blade unit in the target position of the blade unit.

Provision is therefore made in accordance with the invention that the label is indeed completely cut off, but is nevertheless still held by the cutter so that the cut-off label does not simply fall downwardly at an output of the label printer, but is held there until the cut-off label is removed by an operator. An additional presenter, such as is known from the prior art, is thus not necessary.

In accordance with an embodiment of the invention, the cutting blade projects with a fixed overhang over an end face of a blade holder of the blade unit, said end face being disposed in the direction toward the transport roller, with the endless tape or carrier tape labels being disposed with a lower side on the transport roller and, on the travel of the blade unit, the end face of the blade holder contacting an upper side of the endless tape or carrier tape labels such that the endless tape or carrier tape labels are clamped between the transport roller and the end face of the blade holder, and with the cut-off label being held in a clamping manner at the transport roller by the end face of the blade holder in the target position of the blade unit. A secure holding of the cut-off label is thus possible.

The blade unit is in this respect in particular only traveled so far that, in the target position of the blade unit, the end face of the blade holder, with a trailing section, is still located in the region of the endless tape or carrier tape labels. The trailing section is responsible for the holding of the cut-off label.

The blade unit is in particular traveled such that the end face of the blade holder runs along a surface line of the transport roller that is disposed closest to the end face of the blade holder and/or such that the cutting blade runs along a surface line of the transport roller that has a predefined offset from the surface line disposed closest to the end face of the blade holder. The cut-off label can hereby be particularly reliably held at the transport roller by the end face of the blade holder.

It can be detected by means of a detector device whether the cut-off label has been removed from the transport roller, with the blade unit only being automatically traveled out of the target position when it has been detected that the cut-off label has previously been removed from the transport roller. The detector device can e.g. be a light barrier.

On the travel of the blade unit out of the target position, the blade unit can be traveled back into the start position or further into a further start position going beyond the target position and the endless tape or carrier tape labels can subsequently be transported further by one label. The label printer is then ready again for the cutting off of a next label. A return into the start position in particular takes place when the cutting blade has a blade edge only in one direction of travel of the blade unit. A further travel into the further start position going beyond the target position can take place if the cutting blade has a respective blade edge in both directions of travel of the blade unit, i.e. if labels can be cut off in both directions of travel.

In accordance with an embodiment of the invention, to cut off the next label, the blade unit is traveled from the further start position in the reverse direction of travel into a further target position, with the blade unit in this respect again being traveled such that the next label is completely cut off and is correspondingly held at the transport roller by the blade unit in the further target position of the blade unit, with the blade unit being traveled back into the start position after the removal of the next label. Cut-off labels can thus be held at the transport roller in both directions of travel.

The cutting off of labels is in particular continuously repeated first in the direction of travel and then in the reverse direction of travel, but in particular under the condition that the respective previously cut-off label has previously been removed from the label printer or the transport roller by an operator.

It is preferred if the blade unit is traveled such that the cutting blade slides along the surface of the transport roller seated on the surface of the transport roller without penetrating into the transport roller. Otherwise, the cutting blade would successively damage and wear out the transport roller. This would in particular be disadvantageous with self-adhesive linerless endless tape labels that are disposed on the transport roller with their adhesive-coated side. However, for a trouble-free transport of the endless tape labels, it is essential that the surface of the transport roller offers the adhesive no adhesion or only as small as possible an adhesion. This property of the transport roller would be lost over time through the wear due to the penetration of the cutting blade.

The cutting blade is preferably displaceably supported and is preloaded in the direction of the transport roller by means of a spring device, in particular a compression spring. It is hereby in particular made possible that the cutting blade slides along the surface of the transport roller seated on the surface of the transport roller without penetrating into the transport roller since the cutting blade can then deflect in the direction away from the transport shaft on contact with the surface of the transport shaft. Nevertheless, sufficient pressure is exerted onto the cutting blade by the spring force to achieve a clean cut on the cutting off of a label.

Provision can furthermore be made that a reference travel is carried out at a respective predefined point in time, in particular on a start of the label printer, and a reference position of the blade unit, in particular the start position, is calibrated by means of a sensor device that in particular comprises a magnet traveling along with the blade unit and an associated fixed-position magnetic field sensor, in particular a Hall sensor. The knowledge of the reference position of the blade unit makes it possible to travel the blade unit with a high accuracy with respect to the absolute position between the respective start position and the respective target position and vice versa.

The blade unit is in particular linearly travelable transversely, in particular perpendicular, to a transport direction of the endless tape or carrier tape labels. The transport roller is preferably a driven transport roller such that the endless tape or carrier tape labels are also pulled and held under tension in the region of the cutter. A driven print roller of the label printer, into which the cutter is installed, as a rule nevertheless provides a controlled transport of the endless tape or carrier tape labels. However, the transport roller can generally also be a non-driven transport roller that runs along.

Further advantageous embodiments of the invention are described in the dependent claims, in the description of the Figures, and in the drawing.

Figure 2A:
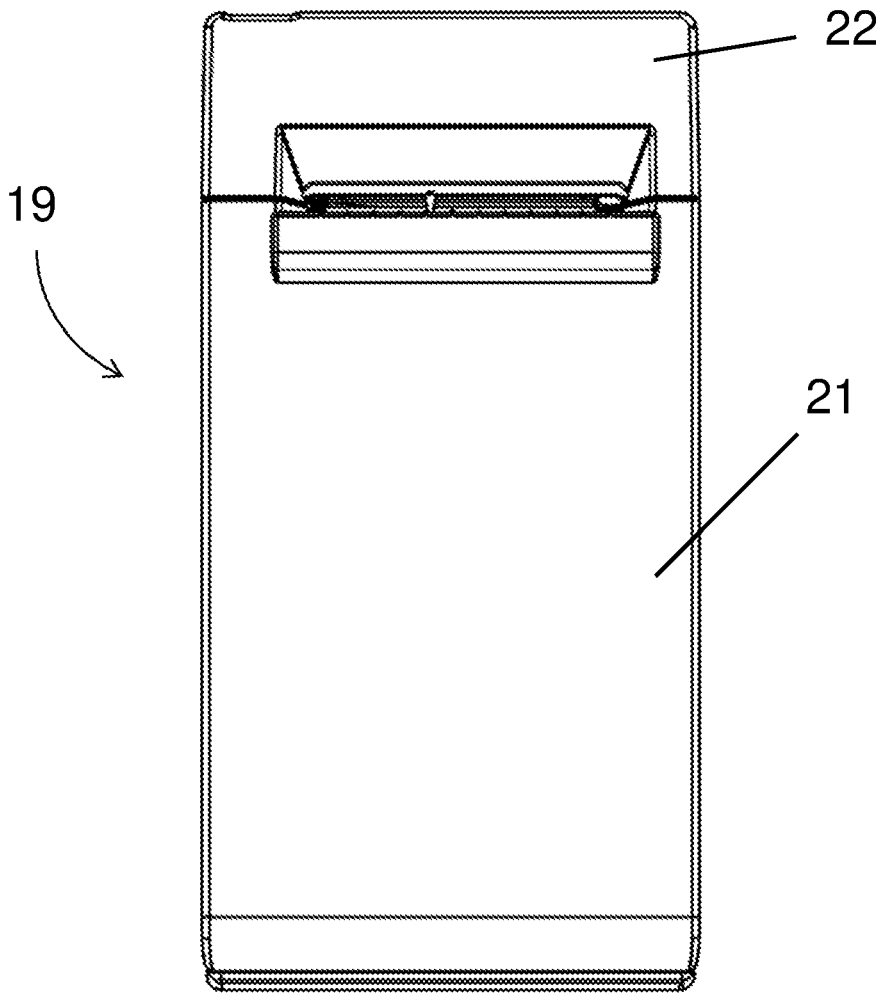
Figure 2B:
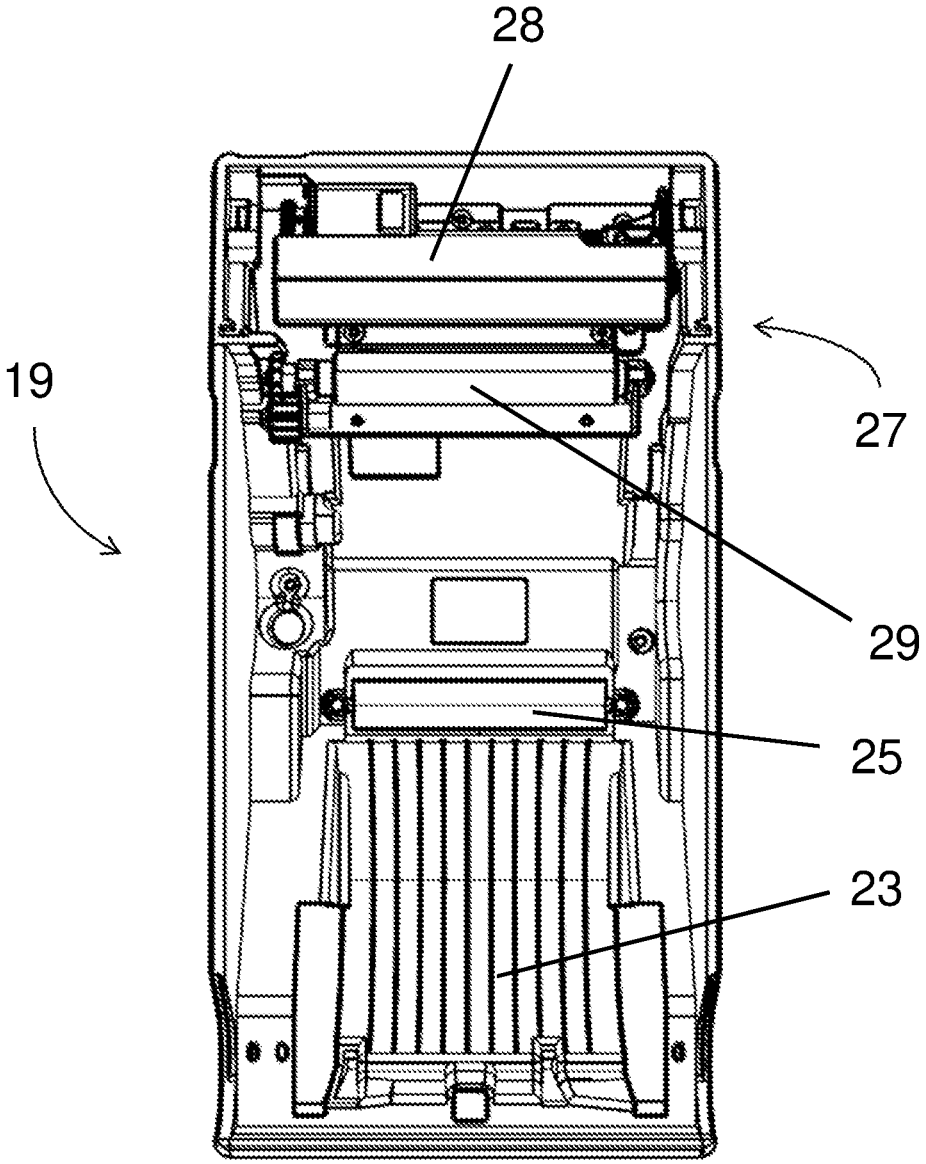
Figure 3:
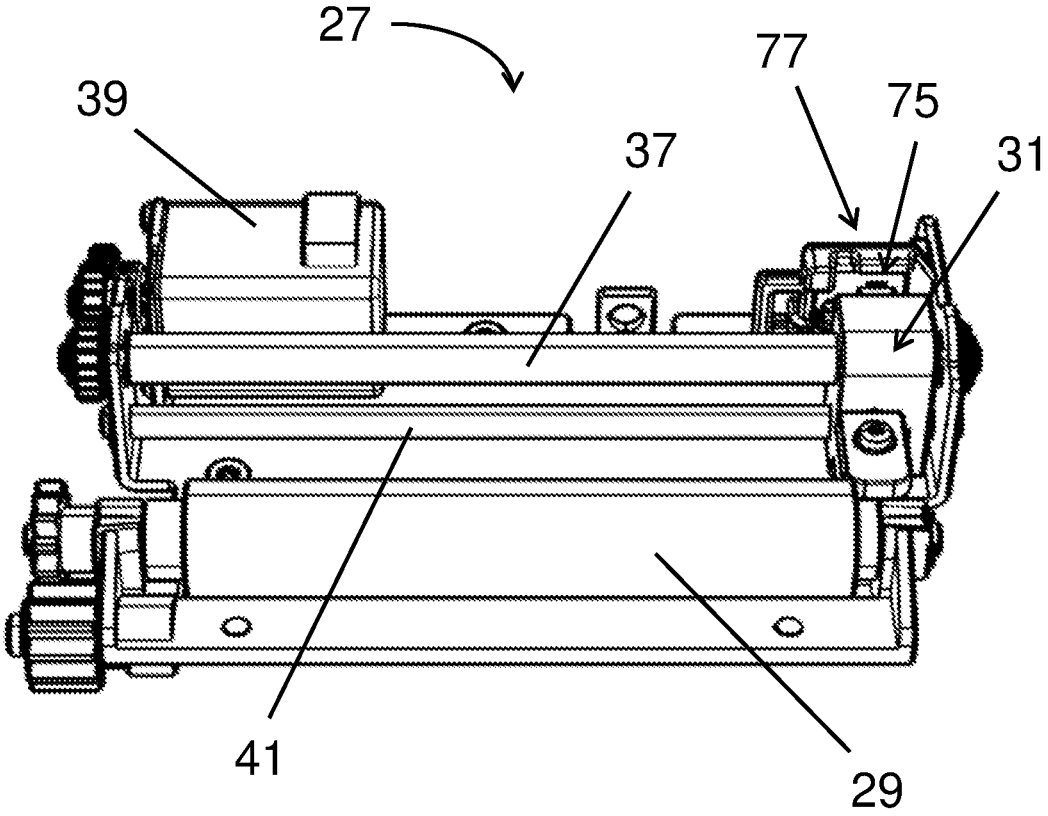
Figure 4A:
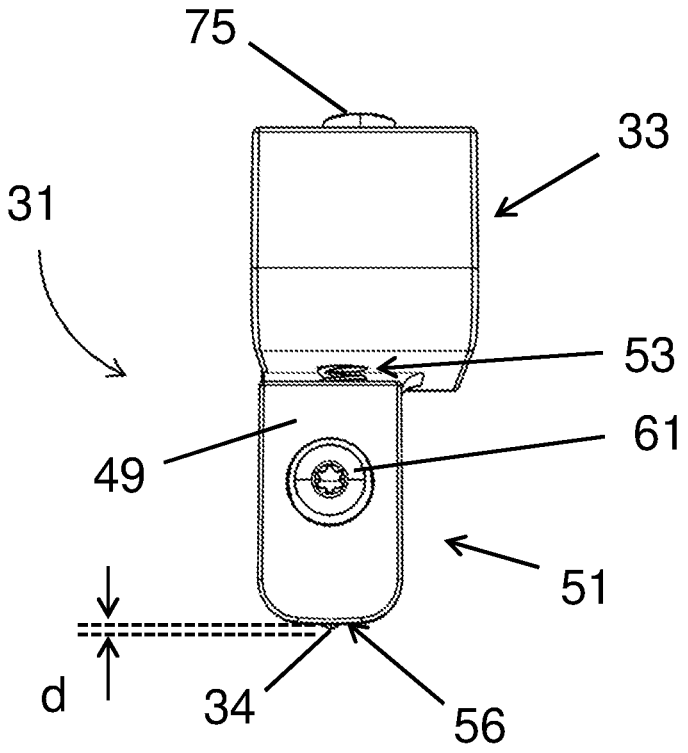
Figure 4B:
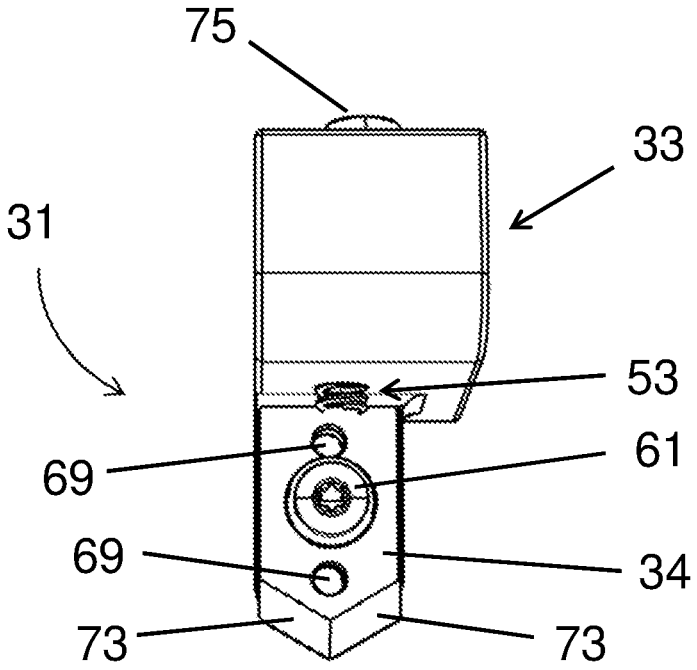
Figure 5A:
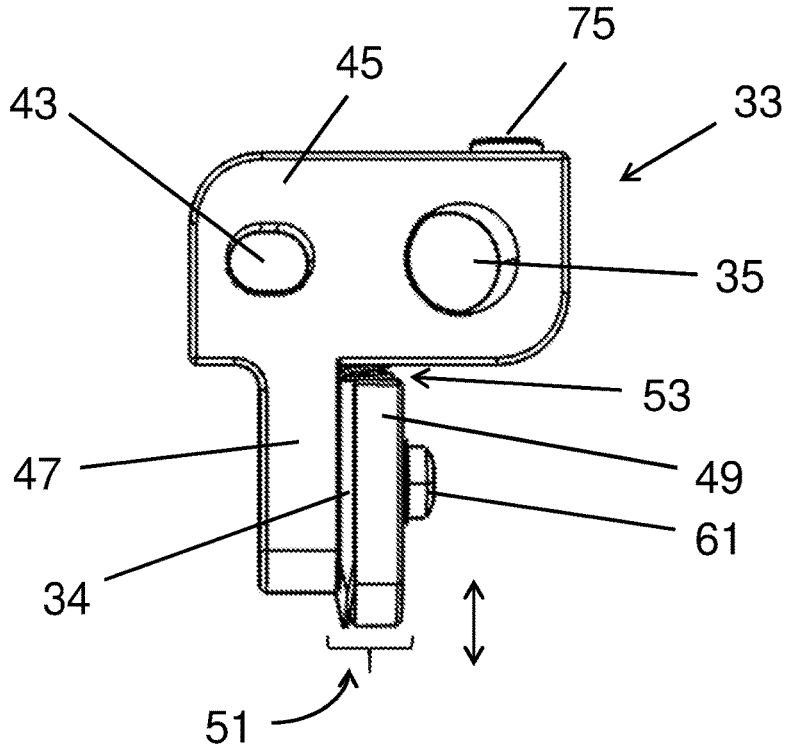
Figure 5B:
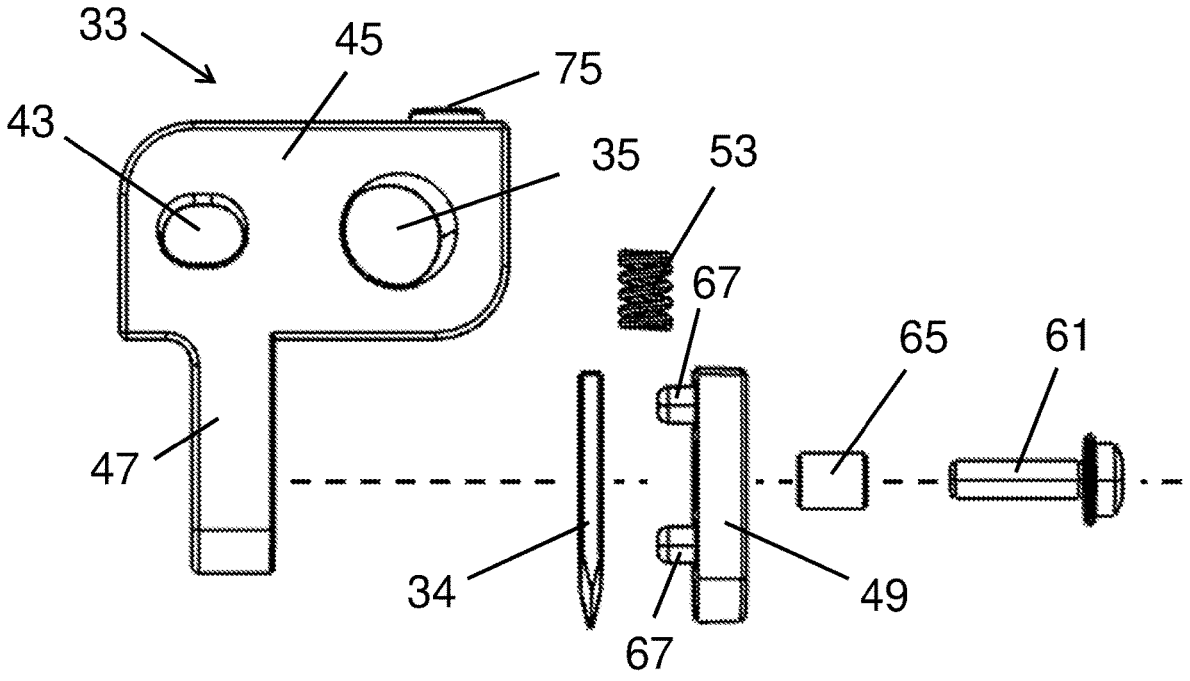
Figure 6A:
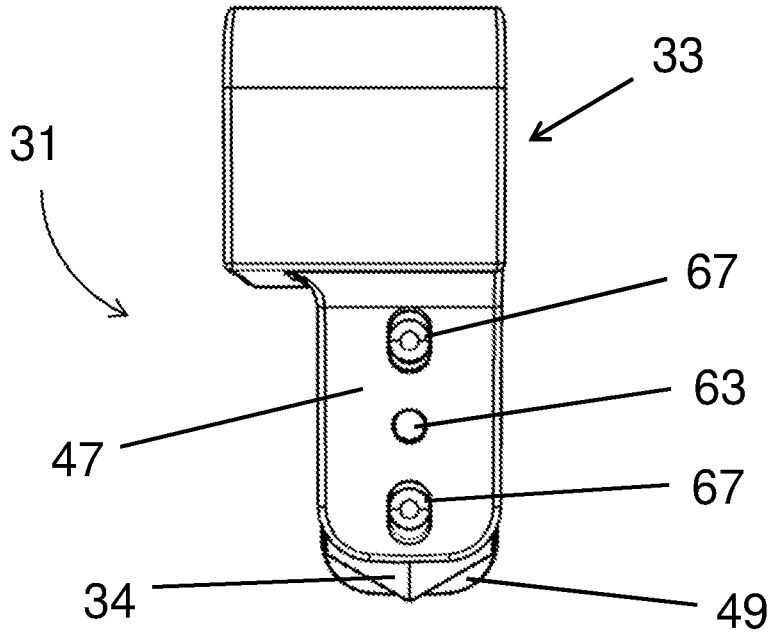
Figure 6B:
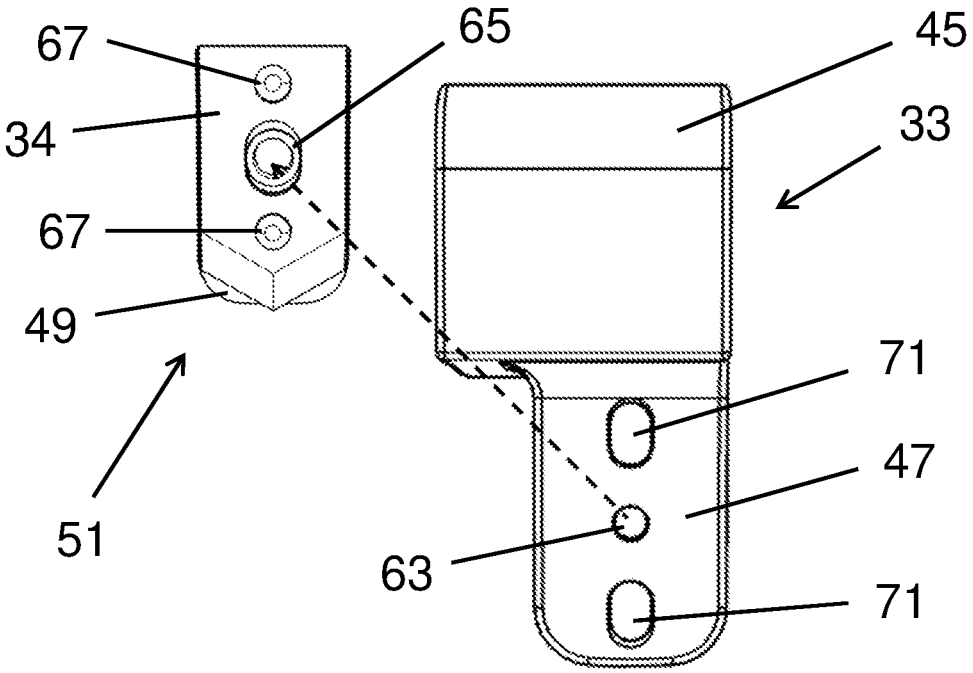
Figure 7:
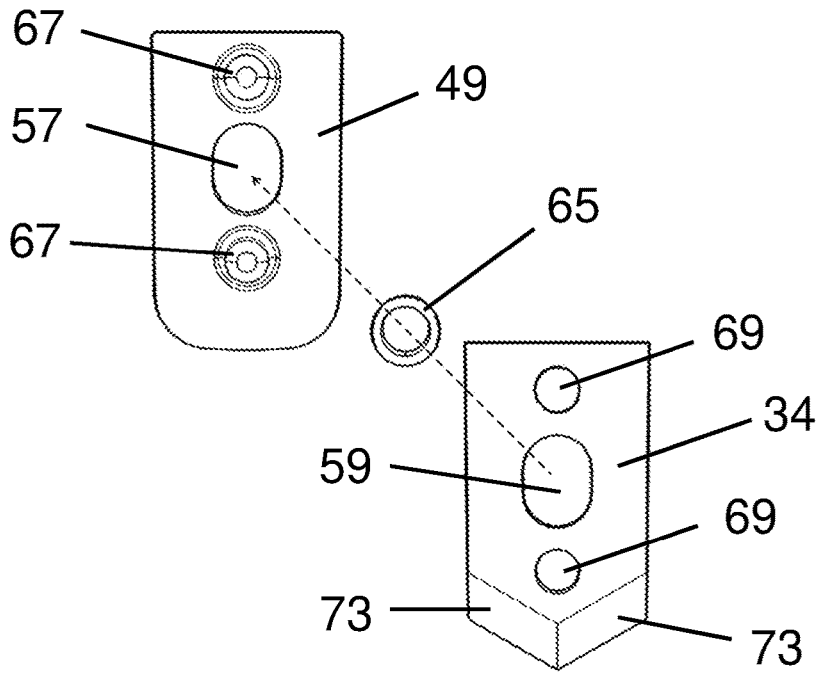
Figure 8A:
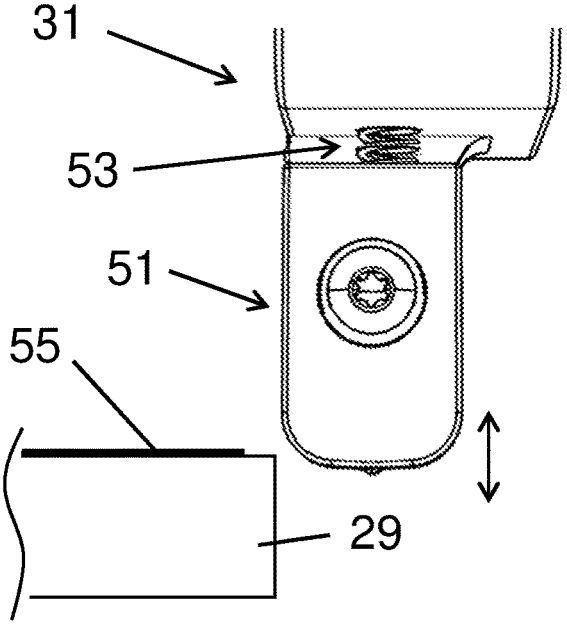
Figure 8B:
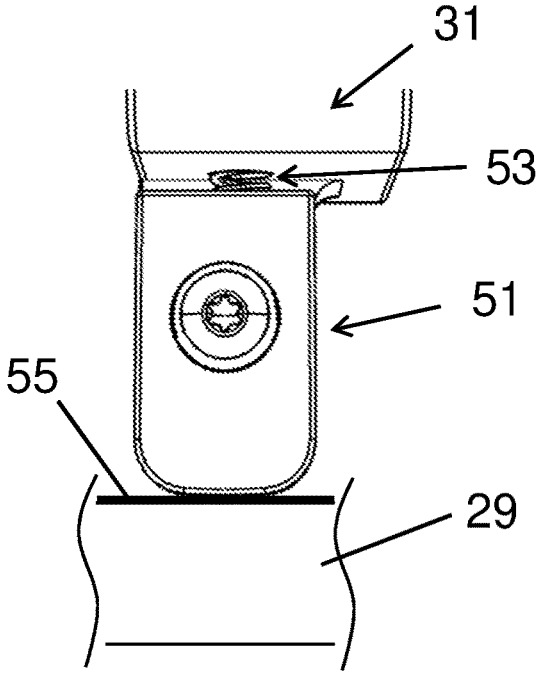
Figure 9:
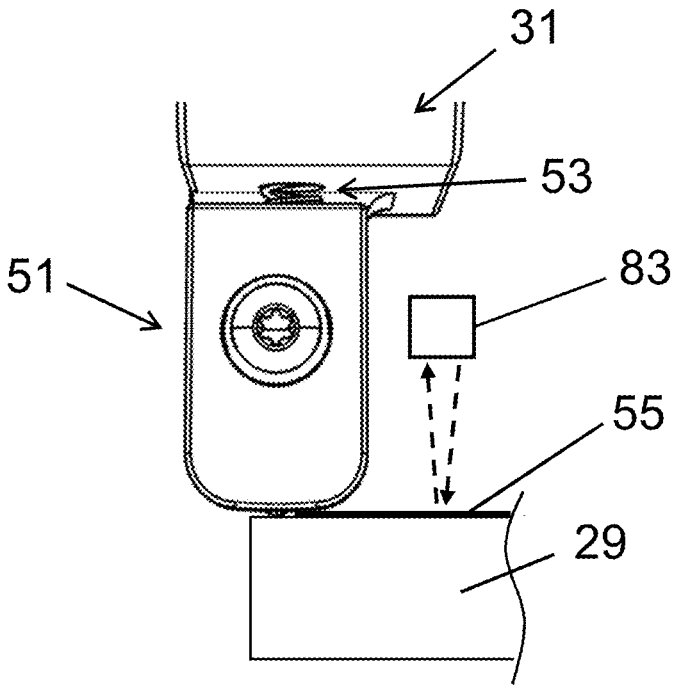
Figure 10:
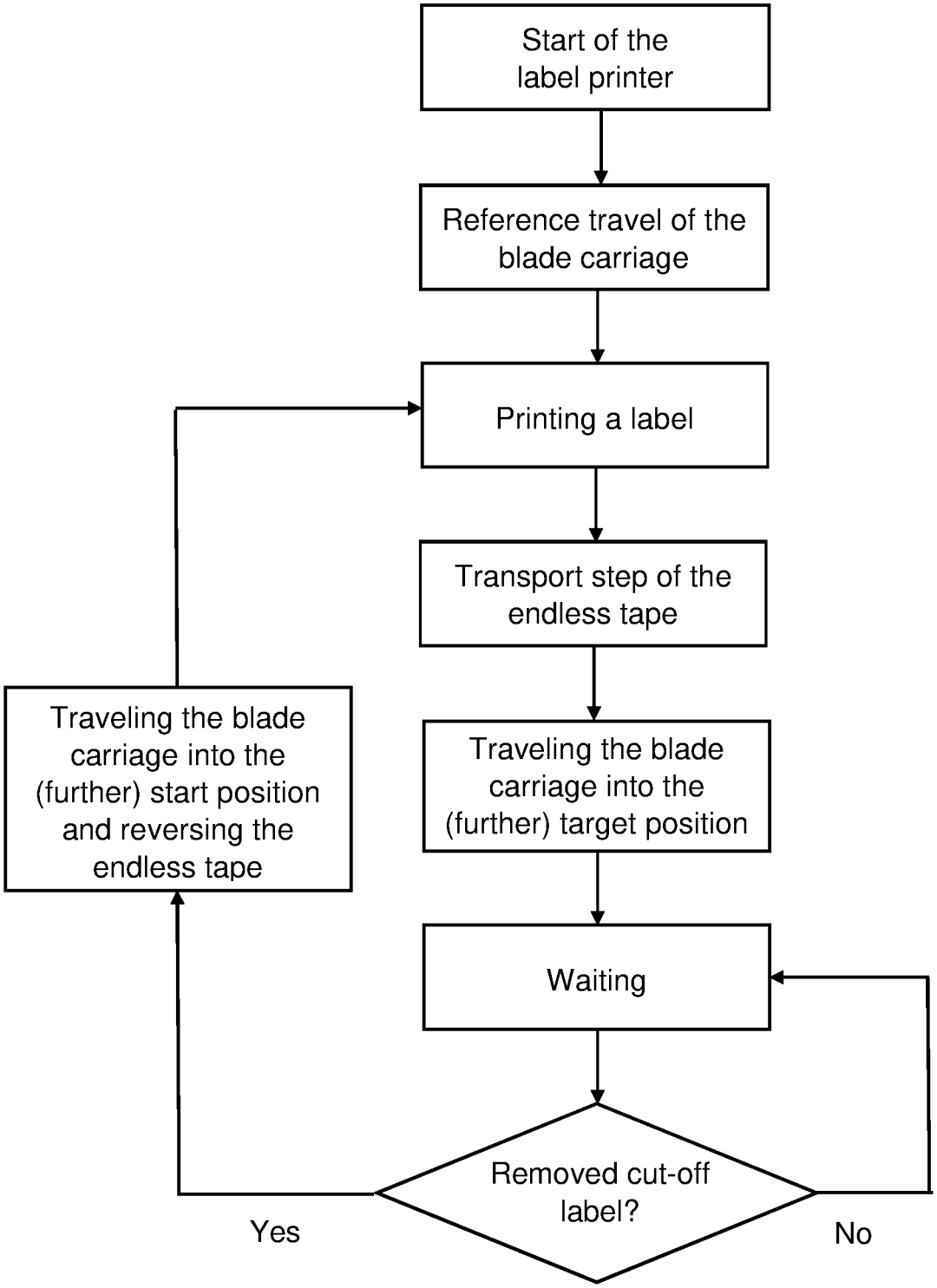
Figure 11:
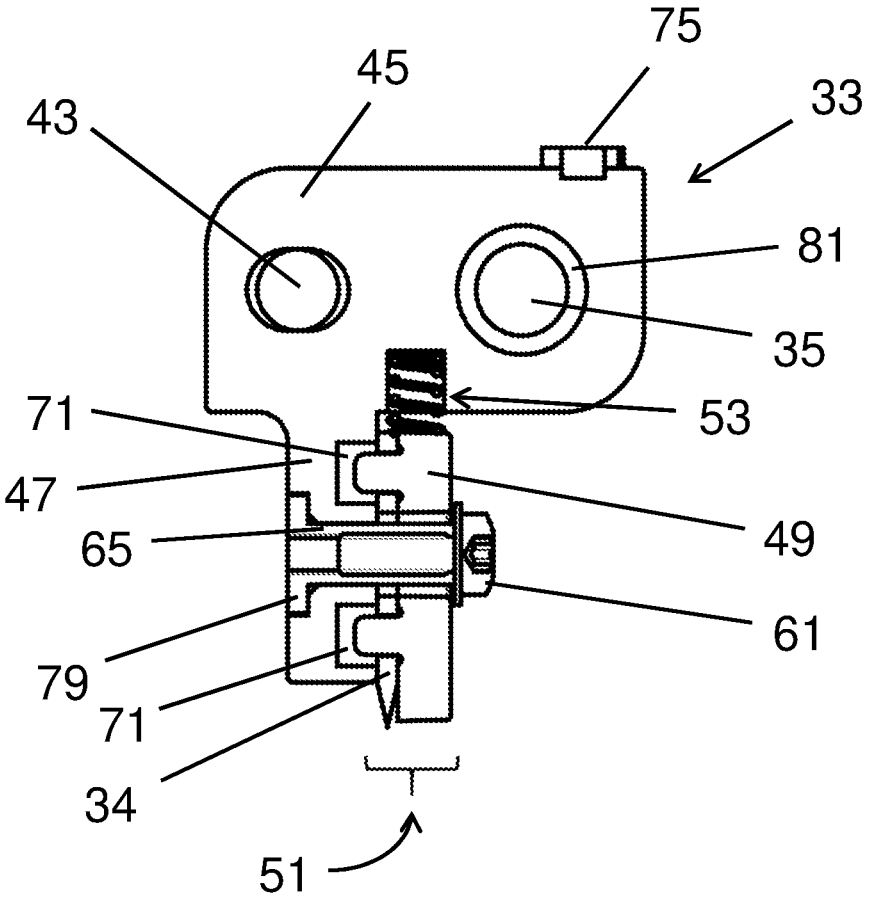

The invention will be described in the following by way of example with reference to the drawing. There are shown FIG. 1 a scale, in particular a store scale, with a label printer;

FIGS. 2A, B the label printer of FIG. 1 in an individual representation with a front-side cover and in a representation in which the front-side cover is omitted such that a cutter is visible;

FIG. 3 the cutter of FIG. 2B in an individual representation with a blade unit;

FIGS. 4A, B the blade unit of FIG. 3 in an individual representation with an assembly comprising a blade holder and a cutting blade in a front view and in a representation in which the blade holder is masked;

FIGS. 5A, B the blade unit of FIG. 4A in a side view and in an exploded representation;

FIGS. 6A, B the blade unit of FIG. 4A in a rear view and in a representation in which the assembly is removed;

FIG. 7 the assembly of FIG. 6B in an exploded representation;

FIGS. 8A, B the blade unit in accordance with FIG. 4A in a representation with the assembly extended and in a representation with the assembly retracted;

FIG. 9 the blade unit in accordance with FIGS. 8A and 8B in a target position;

FIG. 10 a method in accordance with the invention of cutting off endless tape labels; and FIG. 11 an alternative blade unit in a cut side view.

The exemplary store scale 11 shown in FIG. 1 comprises a load plate 13 that determines the weight of an article disposed on it, with the weight being displayed both on a display 15 for the customer and on a display 17 for the salesperson. The display 17 is configured as a touch screen such that the store scale 11 can also be operated via it. An identification number (PLU) associated with the respective article can be input via the touch screen 17 such that a price for the article can be calculated while adding the weight, said price then likewise being displayed on the two displays 15, 17. Furthermore, the store scale comprises a label printer 19 to print the weight, the name of the article, and the calculated price on the label. Furthermore, in FIG. 1, a control device 20 of the store scale 11 is schematically shown that is integrated in the store scale 11 and that is configured to control the operation of the store scale 11, in particular including the label printer 19.

The label printer 19 is shown from the front in an individual representation in FIG. 2A. In FIG. 2B, a front-side cover of the label printer 19 in the form of a flap 21 and a cover section 22 separate therefrom are omitted such that the interior of the label printer 19 can be seen. A receiver 23 for a label roll and a deflection roller 25 are visible in the interior of the label printer 19. A printhead and a print roller of the label printer 19 are, in contrast, not visible in FIG. 2B.

The label printer 19 can in particular be operated with self-adhesive linerless endless tape labels. Therefore, the label printer 19 has a cutter 27 (which is partly concealed by a cover plate 28 in FIG. 2B) by which the labels are cut off from the endless tape. As can be seen from FIG. 3, the cutter 27 comprises a driven transport roller 29 rotatable about an axis of rotation for the endless tape labels. Furthermore, a blade unit 31 is provided that comprises a blade carriage 33 (cf. FIGS. 4A to 6B), which is linearly travelable in parallel with the axis of rotation of the transport roller 29, and a plate-shaped cutting blade 34 that is rotationally fixedly held at the blade carriage 33 and that is directed in the direction toward the transport roller 29. However, the label printer 19 can generally also be operated with receipt paper.

The blade carriage 33 is configured as a spindle nut that has a passage 35 having an internal thread and that is driven in a travelable manner via a threaded rod 37, with which it forms a threaded spindle, by the electric motor 39 in both axial directions of the threaded rod 37. To ensure a stable guidance of the blade carriage 33 on the travel of the blade carriage 33, the cutter 27 furthermore comprises a straight-line guide that extends in parallel with the threaded rod 37 and that is configured as a guide bar 41 that is round in cross-section and that extends through an aperture 43 formed in the blade carriage 33. The aperture 43 has a cross-section in the form of an elongate hole such that tolerances in the spacing between the threaded rod 37 and the guide bar 41 can be compensated.

The self-adhesive linerless endless tape labels are led between the transport roller 29 and the blade unit 31, wherein the adhesive-coated side of the endless tape labels faces the transport roller 29 that acts as a counterholder for the blade unit 31, in particular the cutting blade 34 of the blade unit 31. The two mutually opposite directions of travel of the blade carriage 33 in this respect run perpendicular to the transport direction of the endless tape labels. In FIGS. 2B and 3, the printhead and the print roller are located behind or below the transport roller 29 and are thus—as already mentioned above—not visible in the Figures.

The blade carriage 33 has a base body 45 and a plate-shaped prolongation 47 which projects from the base body 45 in the direction toward the transport roller 29 and at which the cutting blade 34 is held by means of a plate-shaped blade holder 49 of the blade unit 31. The cutting blade 34 is in this respect arranged between the prolongation 47 and the blade holder 49. The prolongation 47, the cutting blade 34, and the blade holder 49 are in this respect arranged contacting one another with their flat sides. The flat sides of these components are thus oriented in parallel with the plane of movement of the cutting blade 34 on the travel of the blade carriage 33. The passage 35 for the threaded rod 37 and the aperture 43 for the guide bar 41 are each provided in the base body 45.

The blade holder 49 and the cutting blade 34 form an assembly 51 (cf. FIGS. 5A, 5B, 6B and 7) that is displaceably fastened to the prolongation 47 of the blade carriage 33 (cf. the respective double arrow in FIGS. 5A and 8A), that is pressed into an extended position (cf. FIG. 8A) by a spring device 53 in the form of a compression spring, and that is pressed back into a retracted position (cf. FIG. 8B) against the spring force of the spring device 53 on a placement of the blade unit 31 onto endless tape labels 55 passing between the transport roller 29 and the blade unit 31. In this respect, the spring device 53 is supported at the base body 45 with the one end and at the assembly 51 with the other end, and indeed both at the blade holder 49 and at the cutting blade 34.

The cushioned support of the cutting blade 34 or of the assembly 51 has the advantage that the cutting blade 34 or the tip of the cutting blade 34 does not penetrate or at least hardly penetrates into the surface of the transport roller 29 on the cutting off of a label, but is rather urged back by a distance with respect to the extended position that is predefined by the distance relationships between the blade unit 31 and the transport roller 29. It can hereby be prevented that the surface of the transport roller 29 is roughened by a continuous cutting in. A surface roughened in such a manner would namely have the result that the endless tape labels adhere more strongly to the transport roller 29 with their adhesive-coated sides over time, whereby a smooth transport of the endless tape labels would be disrupted.

As can in particular be seen from FIG. 4A (and also from FIGS. 5A, 6A and 8A), the cutting blade 34 projects with a defined overhang d over the blade holder 49, in particular an end face 56 of the blade holder 49 disposed in the direction toward the transport roller 29. The penetration depth of the cutting blade 34 into the endless tape labels thus always remains the same. This also applies in the case of tolerance-induced irregularities in the surface of the transport roller 29. The overhang d is in this respect adapted to the thickness of the labels and is selected such that the labels can be safely cut off from the endless tape. For example, the overhang can adopt a value of between 0.1 mm and 0.8 mm, preferably between 0.2 mm and 0.3 mm.

The blade unit 31 is preferably oriented such that, on the travel of the blade carriage 33, the cutting blade 34 or the tip of the cutting blade 34 runs along a surface line of the transport roller 29 that is disposed closest to the cutting blade 34 or the tip of the cutting blade 34. However, it is generally also possible that, on the travel of the blade carriage 33, the cutting blade 34 or the tip of the cutting blade 34 runs along a surface line of the transport roller 29 that has a predefined offset from the surface line disposed the closest.

The displaceable fastening of the assembly 51 comprising the blade holder 49 and the cutting blade 34 is ensured by an elongate hole arrangement. For this purpose, a respective elongate hole 57, 59 is formed in the blade holder 49 and the cutting blade 34, which elongate holes 57, 59 are arranged congruently with one another and through which a fastening screw 61 extends such that the assembly 51 is displaceable along the two elongate holes 57, 59. The fastening screw 61 is fixedly screwed in a fastening hole 33 formed in the prolongation 47 of the blade carriage 33.

So that the assembly 51 is not immovably stuck at the prolongation 47, the assembly 51 is received with clearance between the head of the fastening screw 61 and the prolongation 47 in the axial direction of the fastening screw 61. The clearance is achieved in that a spacer sleeve 65 is provided whose extent in the axial direction of the fastening screw 61 is greater than the corresponding extent of the assembly 51 and through which the shaft of the fastening screw 61 is inserted such that the spacer sleeve 65 also extends through the two elongate holes 57, 59. The head of the fastening screw 61 abuts the spacer sleeve 65 at the one axial end and the prolongation 47 of the blade carriage 33 abuts said spacer sleeve 65 at the other axial end.

The blade holder 49 and the cutting blade 34 are plugged together to form the assembly 51. For this purpose, the blade holder 49 has two pins 67 that project in the direction of the cutting blade 34 and that engage into corresponding openings 69 formed in the cutting blade 34. These two plug-in connections are disposed opposite one another with respect to the fastening screw 61 or the spacer sleeve 65. The two pins 67 of the blade holder 49 extend through the two openings 69 formed in the cutting blade 34 and each engage into a corresponding elongate hole 71 formed in the prolongation 47. It can hereby be reliably prevented that the assembly 51 rotates about the longitudinal axis of the fastening screw 61 or of the spacer sleeve 65.

The blade carriage 33 is travelable to and fro between a first end position to the right of the transport roller 29 (cf. FIG. 8A) and an analogous second end position to the left of the transport roller 29 (not shown) and can cut off labels in both directions of travel. For this purpose, the cutting blade 34 has a blade edge 73 at the respective leading edge in both directions of travel of the blade carriage 33. The two blade edges 73 together form a V shape in the plane of movement of the cutting blade 34 on the travel of the blade carriage 33, whereby a particularly good cutting result can be achieved. Before a change of the direction of travel, the endless tape labels 55 are transported further step-wise in a motorized manner, in each case by one label.

An alternative method in accordance with the invention of cutting off the endless tape labels 55 is shown in FIG. 9. In the alternative method, a label is first printed, then the endless tape labels are transported further by one label, and the blade unit 31 or the blade carriage 33 is subsequently linearly traveled between a start position that corresponds to the aforementioned first end position of the blade carriage 33 (cf. FIG. 8A) and a target position as shown in FIG. 9. As can be seen from FIG. 9, the cutting blade 34 is located to the left of the left edge of the endless tape labels 55, i.e. the label to be cut off has been completely cut off. However, in the target position in accordance with FIG. 9, the cut-off label is held by the blade unit 31 at the transport roller 29 and can then be removed by an operator there.

The holding of the cut-off label in the target position of the blade unit 31 is achieved in that the endless tape labels 55 are disposed on the transport roller 29 with their lower sides and, on the travel of the blade unit 31 from the start position into the target position, are clamped between the end face 56 of the blade holder 49, which is disposed in the direction toward the transport roller 29 and which is disposed on the upper side of the endless tape labels 55, and the transport roller 29. This then in particular also applies to the cut-off label in the target position of the blade unit 31. Finally, the blade unit 31 or the blade carriage 33 is not completely traveled into the aforementioned second end position, but only so far that the end face 56 of the blade holder 49, with a trailing section, is still located in the region of the endless tape labels 55 or of the cut-off label. On the travel of the blade unit 13, the cutting blade 34 is slidingly seated on the surface of the transport roller 29.

In this respect, it is advantageous if, on the travel of the blade unit 31, the end face 56 of the blade holder 49 runs along a surface line of the transport roller 29 that is disposed the closest to the end face 56 of the blade holder 49 since the cut-off label can hereby be held particularly well. The cutting blade 34 or the tip of the cutting blade 34 then runs along a surface line of the transport roller 29 that is offset, in particular slightly offset, therefrom.

It is then waited until the cut-off label is removed by an operator. For this purpose, a detector device 83 is provided by which it is detected whether the cut-off label has been removed by an operator. Only when this is the case does the blade unit 31 automatically travel out of the target position. The blade unit 31 can in this respect either return to the start position or travel further into a further start position, which goes beyond the target position and which corresponds to the aforementioned second end position, and the endless tape labels 55 can be retracted up to the respective label start at which the label was cut off (reversing) before the printing of the next label that has already partly run through the printing region. Then, the method steps explained above are repeated for the next label to be cut off.

If the blade unit 31 has traveled further into the further start position, the blade unit 31, in order to cut off the next label, in this respect travels in the opposite direction of travel, i.e. in the direction of the start position, up to and into a further target position (not shown) that corresponds to the position shown in FIG. 9, but at the right edge of the endless tape labels 55. Therefore, the blade unit 31 is again not completely traveled back into the first end position, but only so far that the end face 56 of the blade holder 49, with a trailing section, is still located in the region of the endless tape labels 55 such that the next cut-off label is also held at the transport roller 29. After the removal of the next label, the blade unit 31 then returns completely to the start position.

To calibrate the start position of the blade unit 31, a reference travel of the blade unit 31 takes place on the switching on of the label printer 19. For this purpose, the blade unit 31 is provided with a magnet 75 that cooperates with a stationary magnetic field sensor 77, in particular a Hall sensor, that detects the magnet 75 moving past (cf. FIG. 3).

A flowchart that illustrates the method steps explained above is shown in FIG. 10, wherein the method steps are controlled or executed by the control device 20. The alternative method can also be performed with carrier tape labels in which the labels are applied to a carrier tape.

In FIG. 11, a blade unit 31 alternative to the blade unit 31 explained in the previous Figures is shown. Unlike in the previous blade unit 31, in the blade unit 31 in accordance with FIG. 11, the spacer sleeve 65 not only extends through the assembly 51, but also through the prolongation 47 of the blade carriage 33. In particular, the spacer sleeve 65 of the blade unit 31 in accordance with FIG. 11, with the other axial end, does not abut the side of the prolongation 47 facing the assembly 51, but rather, with a flange 79 formed at this end, abuts the oppositely disposed side of the prolongation 47. Furthermore, the fastening screw 61 of the blade unit in accordance with FIG. 11 is not screwed in the prolongation 47, but rather in the spacer sleeve 65. To enable the aforementioned clearance of the assembly 51, the extent of the spacer sleeve 65 in the axial direction of the fastening screw 61 is greater than the common extent of the assembly 51 and of the prolongation 47 of the blade carriage 33.

The alternative blade unit 31 in accordance with FIG. 11 has the advantage that no fastening hole having an internal thread is required in the prolongation 47. This is in particular of advantage when the blade carriage 33 comprising the prolongation 47 is produced from a plastic. For the same reason, in the blade unit 31 in accordance with FIG. 11, an insert sleeve 81 is also provided in the passage 35. The spacer sleeve 65 and the insert sleeve 81 can be produced from a metal that can be provided with an internal thread for the fastening screw 61 or for the threaded rod 37 in a simple manner. In another respect, in the alternative blade unit 31 in accordance with FIG. 11, the two elongate holes 71 are indeed formed as countersunk elongate holes, but they can just as well formed as continuous elongate holes.

REFERENCE NUMERAL LIST

11 store scale
13 load plate
15 customer display
17 operator touch screen
19 label printer
20 control device
21 flap
22 cover section
23 receiver
25 deflection roller
27 cutter
28 cover plate
29 transport roller
31 blade unit
33 blade carriage
34 cutting blade
35 passage
37 threaded rod
39 electric motor
41 guide bar
43 aperture
45 base body
47 prolongation
49 blade holder
51 assembly
53 spring device
55 endless tape labels
56 end face
57 elongate hole
59 elongate hole
61 fastening screw
63 fastening hole
65 spacer sleeve
67 pin
69 opening
71 elongate hole
73 blade edge
75 magnet
77 magnetic field sensor
79 flange
81 insert sleeve
83 detector device
d overhang

The invention claimed is:

1. A method of cutting off self-adhesive linerless endless tape labels or carrier tape labels using a cutter of a label printer, wherein the cutter comprises a transport roller, which is rotatable about an axis of rotation, and a blade unit that is linearly travelable in parallel with the axis of rotation of the transport roller and that has a cutting blade directed in a direction toward the transport roller, the method comprising passing the endless tape or carrier tape labels between the transport roller and the blade unit, transporting the endless tape or carrier tape labels further motorically step-wise, in each case by one label, and, in each case between two consecutive further transport steps, travelling the blade unit motorically and linearly between a start position and a target position in order to cut off a label, wherein the blade unit is traveled such that the label is completely cut off and is held at the transport roller by the blade unit in the target position of the blade unit.

2. The method in accordance with claim 1, wherein the cutting blade projects with a fixed overhang over an end face of a blade holder of the blade unit, said end face being disposed in the direction toward the transport roller, the method further comprising:

disposing the endless tape or carrier tape labels with a lower side on the transport roller, on the travel of the blade unit, the end face of the blade holder contacting an upper side of the endless tape or carrier tape labels such that the endless tape or carrier tape labels are clamped between the transport roller and the end face of the blade holder, and holding the cut-off label in a clamping manner at the transport roller by the end face of the blade holder in the target position of the blade unit.

3. The method in accordance with claim 2, further comprising travelling the blade unit only so far that, in the target position of the blade unit, the end face of the blade holder with a trailing section is still located in a region of the endless tape or carrier tape labels.

4. The method in accordance with claim 2, further comprising travelling the blade unit such that the end face of the blade holder runs along a surface line of the transport roller that is disposed closest to the end face of the blade holder; and/or travelling the blade unit such that the cutting blade runs along the surface line of the transport roller that has a predefined offset from the surface line disposed closest to the end face of the blade holder.

5. The method in accordance claim 1, further comprising detecting by means of a detector device whether the cut-off label has been removed from the transport roller, with the blade unit only being automatically traveled out of the target position when detected that the cut-off label has previously been removed from the transport roller.

6. The method in accordance with claim 5, further comprising travelling the blade unit out of the target position back to the start position or to a further start position going beyond the target position; and subsequently transporting, motorically step-wise, the endless tape or carrier tape labels further by one label.

7. The method in accordance with claim 6, further comprising to cut off a next label, travelling the blade unit from the further start position in a reverse direction of travel into a further target position, with the blade unit in this respect again being traveled such that the next label is completely cut off and is correspondingly held at the transport roller by the blade unit in the further target position of the blade unit, with the blade unit being traveled back into the start position after the removal of the next label.

8. The method in accordance with claim 7, further comprising repeating the cutting off of labels continuously first in the direction of travel and then in the reverse direction of travel.

9. The method in accordance with claim 1, further comprising travelling the blade unit such that the cutting blade slides along a surface of the transport roller without penetrating into the transport roller.

10. The method in accordance with claim 1, further comprising supporting the cutting blade displaceably, and preloading the cutting blade in the direction of the transport roller by means of a spring device.

11. The method in accordance with claim 1, further comprising carrying out a reference travel at a respective predefined point in time, and calibrating a reference position of the blade unit by means of a sensor device.

* * * * *